US010440789B2

(12) United States Patent
Bhagwat et al.

(10) Patent No.: US 10,440,789 B2
(45) **Date of Patent: *Oct. 8, 2019**

(54) EVENT BASED INTEGRATED DRIVER SYSTEM AND LIGHT EMITTING DIODE (LED) DRIVER SYSTEM

(71) Applicant: GLOBALFOUNDRIES INC., Grand Cayman (KY)

(72) Inventors: Hrishikesh Bhagwat, Bangalore (IN); Krishnadas Bhagwat, Bangalore (IN); Rajesh Swaminathan, Bangalore (IN); Somnath Samantha, Bangalore (IN); Abhisek Khare, Bangalore (IN)

(73) Assignee: GLOBALFOUNDRIES Inc., Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 15/024,607

(22) PCT Filed: Jun. 13, 2014

(86) PCT No.: PCT/IB2014/062215

§ 371 (c)(1),
(2) Date: Mar. 25, 2016

(87) PCT Pub. No.: WO2015/044797

PCT Pub. Date: Apr. 2, 2015

(65) Prior Publication Data

US 2016/0249425 A1 Aug. 25, 2016

(30) Foreign Application Priority Data

Sep. 27, 2013 (IN) ..... 4410/CHE/2013

(51) Int. Cl.
*H05B 33/08* (2006.01)

(52) U.S. Cl.
CPC ..... *H05B 33/0845* (2013.01); *H05B 33/0815* (2013.01); *H05B 33/0884* (2013.01)

(58) Field of Classification Search
CPC ..... H05B 33/08; H05B 33/0815; H05B 33/0845; H05B 33/0833; H05B 33/0839;
(Continued)

(56) References Cited

U.S. PATENT DOCUMENTS 8,026,676 B2 * 9/2011 Liu ..... H05B 33/0848 315/291
8,258,714 B2 * 9/2012 Liu ..... H05B 33/0818 315/210

(Continued)

FOREIGN PATENT DOCUMENTS

CN 101466192 6/2009
CN 103120024 5/2013

OTHER PUBLICATIONS

STMicroelectronics group of companies, S.R.L, AN4291 Applicaition note, 1-23, Jun. 12, 2013 (Jun. 12, 2013), pp. 1-45.*

(Continued)

*Primary Examiner* — Thai Pham
(74) *Attorney, Agent, or Firm* — Thompson Hine LLP

(57) ABSTRACT

An event based integrated driver system for an end-use power based application is disclosed. The driver system includes an analog module for operating analog input and analog output, a digital module for operating digital input and digital output, a software module for operating software input and software output, an event based module to receive the analog output, digital output or software output, and configured to generate one or more events corresponding to the analog output, digital output and software output respectively, a firmware module configured to generate a response for the one or more events and transmit the response via the event based module to operate at least one of the analog (Continued)

module, digital module, or software module, where the firmware module comprises instructions for operating the analog module, the digital module and the software module based on the end-use power based application.

23 Claims, 11 Drawing Sheets

(58) Field of Classification Search
CPC ..... H05B 33/0851; H05B 33/0818; H05B 33/0827
USPC ..... 315/210, 247, 250, 291, 294, 297, 307, 315/308, 312
See application file for complete search history.

(56) References Cited

U.S. PATENT DOCUMENTS

2014/0128941 A1* 5/2014 Williams ..... A61N 5/06 607/88
2014/0230733 A1* 8/2014 Miller ..... C23C 16/00 118/724

OTHER PUBLICATIONS

Stmicroelectronics S.R.L. "AN4291 Application Note" 1-23, Jun. 12, 2013 (Jun. 12, 2013), pp. 16-24 and 29-33 and 44-45.

* cited by examiner

EVENT BASED INTEGRATED DRIVER SYSTEM AND LIGHT EMITTING DIODE (LED) DRIVER SYSTEM

This application takes priority from the Provisional Application 4410/CHE/2013 filed with Indian Patent office on 27 Sep. 2013.

FIELD OF THE INVENTION AND USE OF INVENTION

The invention relates generally to a driver system for different applications such as light emitting diodes (LED) and more specifically to an event based integrated driver system for optimized use of analog, digital and firmware module useful in achieving low power consumption, higher accuracy and better functionality in applications such as LEDs.

Prior Art and Problem to be Solved

Analog systems communicate with continuous signals and the response to these signals is implemented in analog domain as well, i.e. the ability to detect these signals and subsequent events are all analog in nature. This is very efficient in terms of accuracy and power consumption. The problem with this approach is the need for dedicated solutions and integrated circuitry (IC or chipset) for each real world analog problem. Further certain functionalities, such as image processing, cannot be effectively implemented in analog domain and need digital process techniques.

To alleviate pure analog system approach limitations certain mixed signal architectures have been proposed and implemented. These architectures are combination of analog and digital techniques. Some of these techniques are described briefly herein below.

One technique of mixed signal architecture is an all analog signal with digital programmability. In this technique, the basic architecture is analog in nature, and certain thresholds, parameters can be programmed digitally. These digital levels are internally transferred from digital to analog domain and subsequently processed. This approach gives a limited programmability but does not give total system response flexibility.

Another technique is a digital centric architecture. The external analog signals are converted to digital domain and all subsequent processing is in the digital domain. This gives greater flexibility, higher digital functionality but at the cost of power (higher clock rates), accuracy, and system cost. Further such an approach increases digital content, area and increases IC cost. To alleviate this area penalty one is forced to migrate to lower IC process geometries. In addition integration of high voltage devices at these advanced modes may not be commercially possible using this technique. Another approach is a digital centric architecture with firmware. Here software is used to change system response. However, most of these available approaches results in complicated software and hardware interactions and make the overall design cycle complicated.

The above approaches further manifest system limitations in the field of LEDs and LED driver circuits, and similar limitations in other technical applications. LEDs today are being used in a variety of applications as indicator lamps and in different types of lighting environments, for example in aviation lighting, digital microscopes, automotive lighting, backlighting, advertising, general lighting, and traffic signals. Customized lighting solutions using LEDs are also being desired by the consumers.

Typically, the LED driver circuit is incorporated in an IC and is a constant current source that drives the LEDs to provide constant illumination. LED systems have their own requirements and limitations such as LED lighting is susceptible to flicker, thermal runaway issues and various fault scenarios and requires more precise current and heat management.

OBJECTS OF THE INVENTION

There is a need for a new analog-digital-firmware solution that reduces power consumption however maintaining the accuracy, reusable architecture (platform architecture), higher integration in terms of functionality, reduction in external components and functionality in applications such as LED driver circuits.

SUMMARY OF THE INVENTION

In one aspect of the invention an event based integrated driver system is provided. The system includes an analog module, a digital module, a firmware module, that interact via an event based module. The analog module and the digital module generate one or more events, and a response to the one or more events is determined by the firmware module. This approach results in low power consumption, simplified firmware, lower digital content, lower operating speeds, higher functionality and high system flexibility.

In one specific non-limiting exemplary implementation, the event based integrated driver system is a LED driver system and is configured to regulate LED current, detect and respond to system faults. The LED driver system supports single and multi string operation and the response of each string can be controlled through the firmware module.

DRAWINGS

These and other features, aspects, and advantages of the present invention will become better understood when the following detailed description is read with reference to the accompanying drawings in which like reference numerals represent corresponding parts throughout the drawings, wherein.

DETAILED DESCRIPTION OF THE INVENTION

As used herein and in the claims, the singular forms "a," "an," and "the" include the plural reference unless the context clearly indicates otherwise.

As used herein, the term "LED" means light emitting diodes which is a semiconductor light source capable of emitting different colored light intensity such as but not limited to red, visible, ultraviolet, infra-red wavelengths.

As used herein, the term "LED circuit" is an electric power circuit used for powering an LED.

As used herein, the term "firmware" means embedded software and computer programs and instructions or code, memory and data stored in it, specifically in relation to the invention firmware has control and operating instructions for all events.

Figure 1:
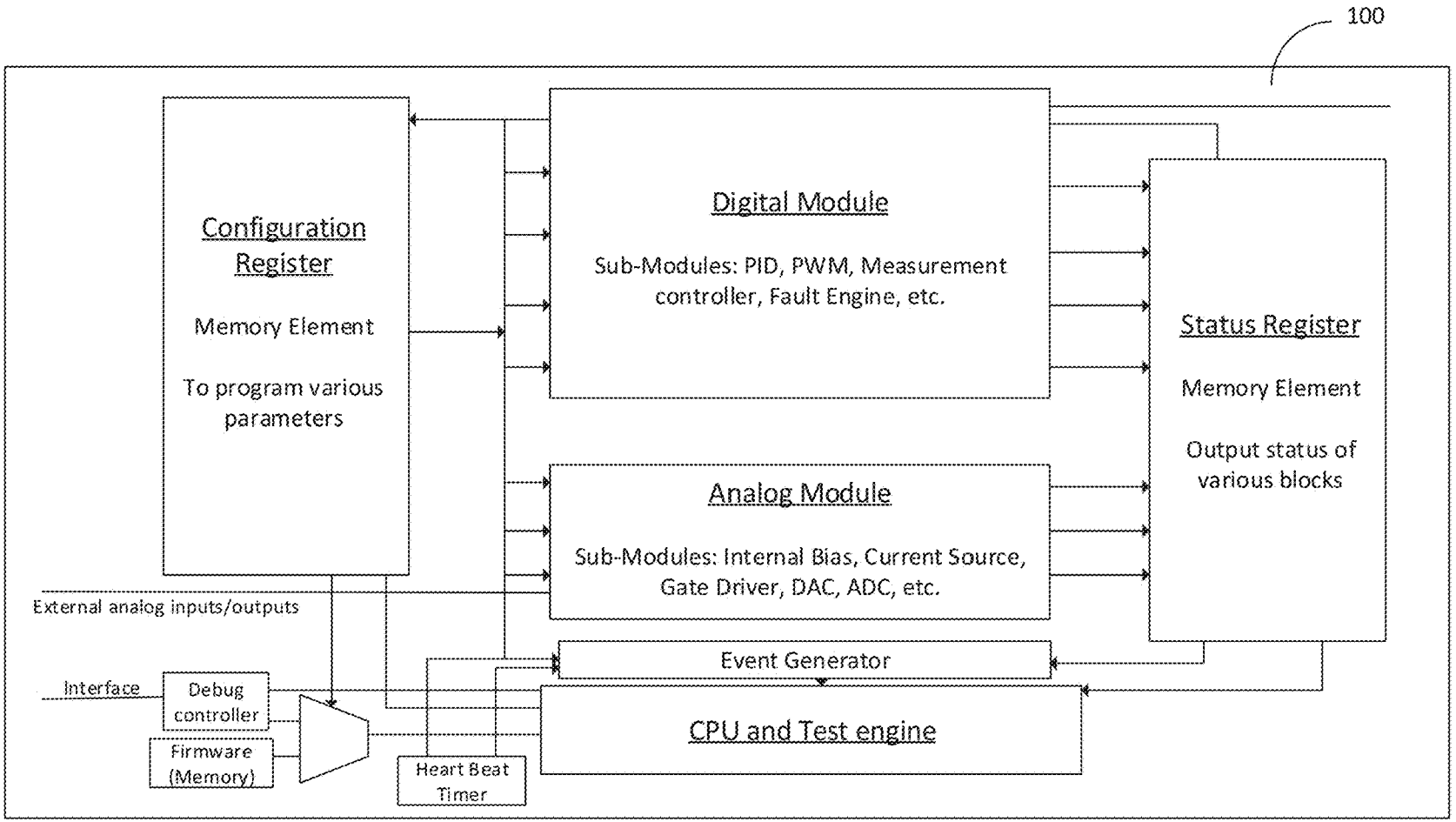
FIG. 1 is a diagrammatic representation of a functional block diagram of an LED driver system according to one embodiment of the invention.

FIG. 1 is a diagrammatic representation of a driver system such as an LED driver system in one practical implementation as an event based integrated driver system according to one embodiment of the invention. The system includes an analog module, a digital module, a software module, a firmware module, that interact via an event based module. The analog module, the digital module or software module are configured to receive an external input in their respective domains, and subsequently generate one or more events corresponding to the external signal received. Thus all the external analog signals are processed in analog domain and analog signal interactions within the functional analog module results in an event. For example, an analog signal will be processed though A/D converter in the analog module which triggers an event in the event based module.

Similarly if the external input is digital in nature, the digital input will be received and processed in the digital module, for example a phase detector in the PWM engine of the digital module, and will result in an event. Similarly, a software input will be processed through an software module, for example an interface like SPI, and would also result in an event. The event is mapped to the firmware module which has instructions for processing the event. The events have priority and the firmware module responds accordingly and the response to event based on the instructions in the firmware can again be implemented through one of analog module, digital module or software module, based on the required application.

The benefits of this system is that the digital module does not have to operate at high speeds and at the same time there is no loss in accuracy of analog signals, and further some specific applications can be simply implemented through a software module directly. The firmware module includes instructions and commands that define how the system should function and results in higher system flexibility. This approach results in optimized use of the functionalities of analog, digital, software and firmware modules for the desired application.

In a specific implementation, in addition to analog module, specific digital blocks in the digital module are implemented as per the functionality requirements. In addition such digital blocks can be independently operated at higher speeds as per the case. One of the advantages of the driver system of the invention is that over all system is running at slower speed and individual digital blocks can operate at different clock speeds. The outputs (results) from these digital blocks of the digital module are also treated as events. This technique reduces over all power consumption and pushes the optimal content to digital domain as per the functionality. This results in excellent tradeoff between power, accuracy and functionality. The different modules and their components that are shown in the exemplary schematic 100 of a driver system in FIG. 1, and are described herein below.

Configuration Register: This is a configuration memory element in which various parameter values are stored. Some of the examples for parameters are LED current level, over temperature set point, over voltage level set point and so on. These values can be configured through an external user interface.

Status Register: This is a status memory element in which output status of various sub modules such as analog, digital, firmware ware are stored.

Digital Module: includes components configured to perform digital functions. Some of the exemplary digital components are:

PID Engine—configured for closed loop compensation control

PWM Engine—configured for calculating PWM duty cycle for dimming purpose

Fault Engine—configured for calculating digital fault bands and threshold

Multipler unit—configured for mathematical computations

Analog Module: includes components configured to process analog signals. Some of the examples are:

Internal Bias engine—configured for generating internal voltage supplies, references Current source engine—configured for defining and regulating a constant current Gate Drive unit—configured for providing drive for power Gate stage DAC—Digital to Analog Converter ADC—Analog to Digital Converter Temp Sensor—configured for sensing temperature Event Generator (referred herein as event based module)—As explained hereinabove, an event is an outcome of a hardware functionality or a programmed functionality that is implemented as computer readable instructions on a computer readable medium. Each event has a certain priority and event generator resolves which code block in CPU should be executed based on incoming events, the configuration and the priority.

CPU—Central Processing unit—The CPU is the brain of the system and executes the code block in accordance with the event. This also configures various hardware blocks and performs basic computation.

Firmware module—This is the code or computer readable instructions (software) written to control a functionality. CPU operates on the firmware as defined by the event generator. The firmware is stored in an internal memory element. The firmware can also reside external to chip and can be transmitted through an interface.

Heart beat timer—configured to ensure event generator is alive if in absence of any internal event as defined by status register.

Debug controller (Software module)—configured to assist in debugging the integrated chip. A special debug code can be transmitted through debug controller. The debug controller can directly control CPU if required.

External Analog Inputs—Analog input signals from outside the chip. These signals directly interact with analog module.

Interface—This is used to transmit digital input/outputs. Some of the examples as would be understood to those skilled in the art are I2C interface, SPI, UART, two wire, Dali etc. The firmware module can be programmed through the interface. The interface can be used to ascertain the condition of the driver system, for example in the embodiment of the LED driver system, parameters such as LED currents, and the fault warnings of the LED driver IC can be communicated to outside world.

It would be appreciated by those skilled in the art that driver system architecture described herein is modular and scalable. Thus, if a specific hardware functionality is required (either digital or analog) then such components can be added without changing CPU and over all architecture. It can be appreciated that this architecture is modular both in terms of digital, analog, software and firmware perspective.

The analog, digital and software modules generate events from the event register based on the external input and these events are processed based on the instructions in the firmware module to generate a response that is sent to the analog module or digital module or any other special function hardware or software functionality via the event register.

The external input as referred herein can be implemented through a software that defines an event through an interface on an integrated circuit or chip incorporating the analog and digital modules. This software related "event" as used herein is an outcome of hardware or software functionality. Hardware can be analog or digital or a combination of both. Software can be internal or external code. The result of such software/hardware functionality is an event. The architecture follows (i.e. subsequent functionality is defined based on event) the event.

Figure 2:
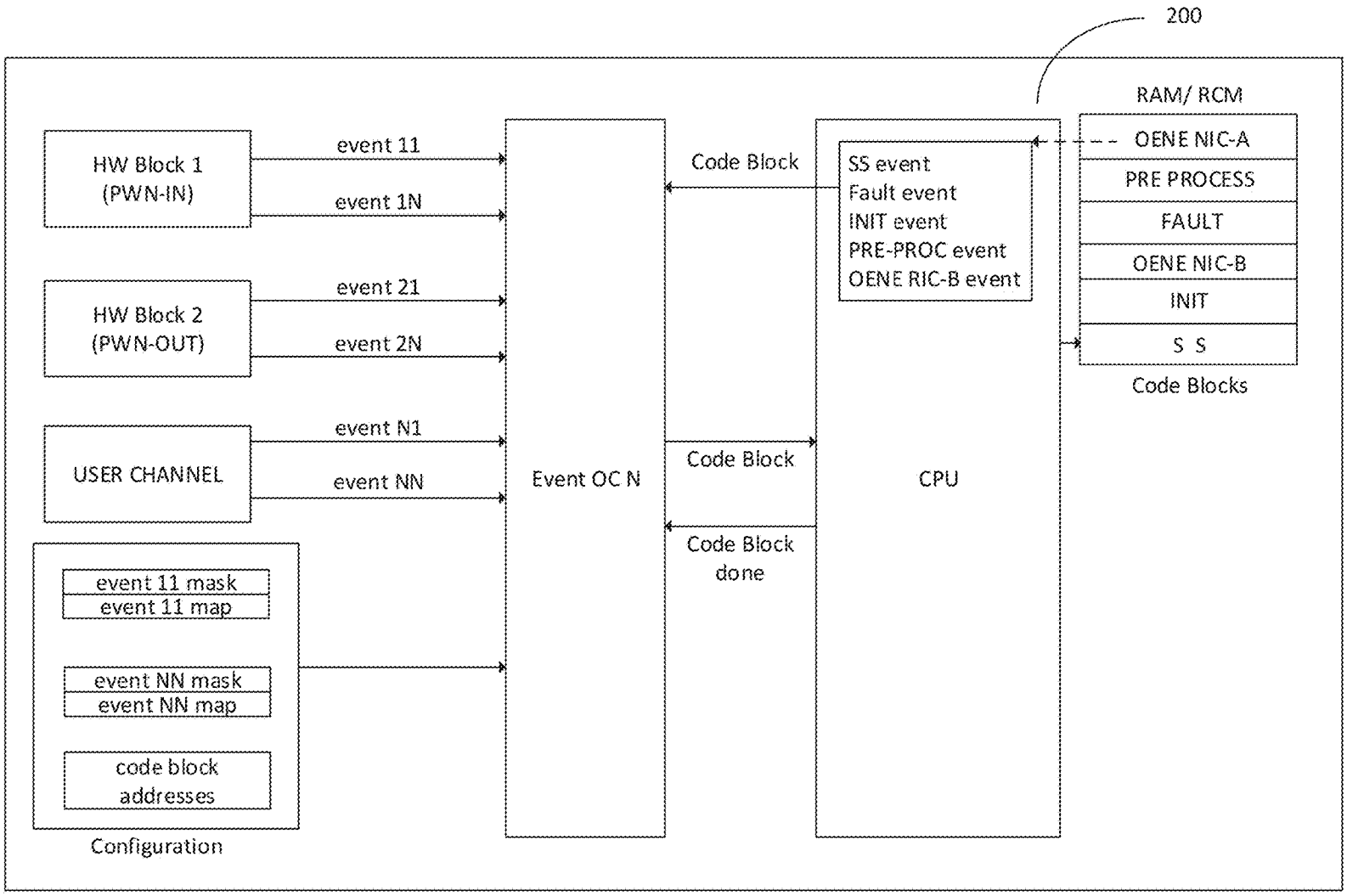
FIG. 2 is diagrammatic representation of an exemplary system architecture of the LED driver system based on the functional block diagram of FIG. 1.

Some exemplary use-cases of the event driven architecture of the invention are as follows:

a. For debugging the chip (a specific debug related response is activated from an external "event").

b. For communication with another chip to activate certain response—daisy chain multiple chips (through Master/slave configuration)

c. For enabling interaction between the chips without the need of an external microcontroller d. For designating master/slave status and specifying address through a single pin, without the need of external micro controller system. Here an analog input is used to configure chips as master/slave and assign appropriate address in a device. This feature enables device to device communication. As stated, the address gets specified thorough an analog signal level (for instance voltage). This analog signal level in an exemplary implementation is established with a simple resistor network on a pin. The resultant analog signal is then internally translated by the chip as its address. This way in a multi IC system, each chip is able to communicate with another chip effectively and there is no need to specify "designate" address by any external system. This dynamic addressing capability offers several advantages as it provides flexibility in implementing the desired functionalities in an application. FIG. 2 is an exemplary diagrammatic representation 200 for event flow sequence for use in the schematic of FIG. 1. As described herein above the different modules generate events through status registers. Both hardware and software components can generate events. These events have priority as determined by event generator. The priority can be static or dynamic in nature. The events are mapped to a code block and based on priority, CPU executes code block associated with events. CPU thus communicates the event resolution to event generator.

Figure 3:
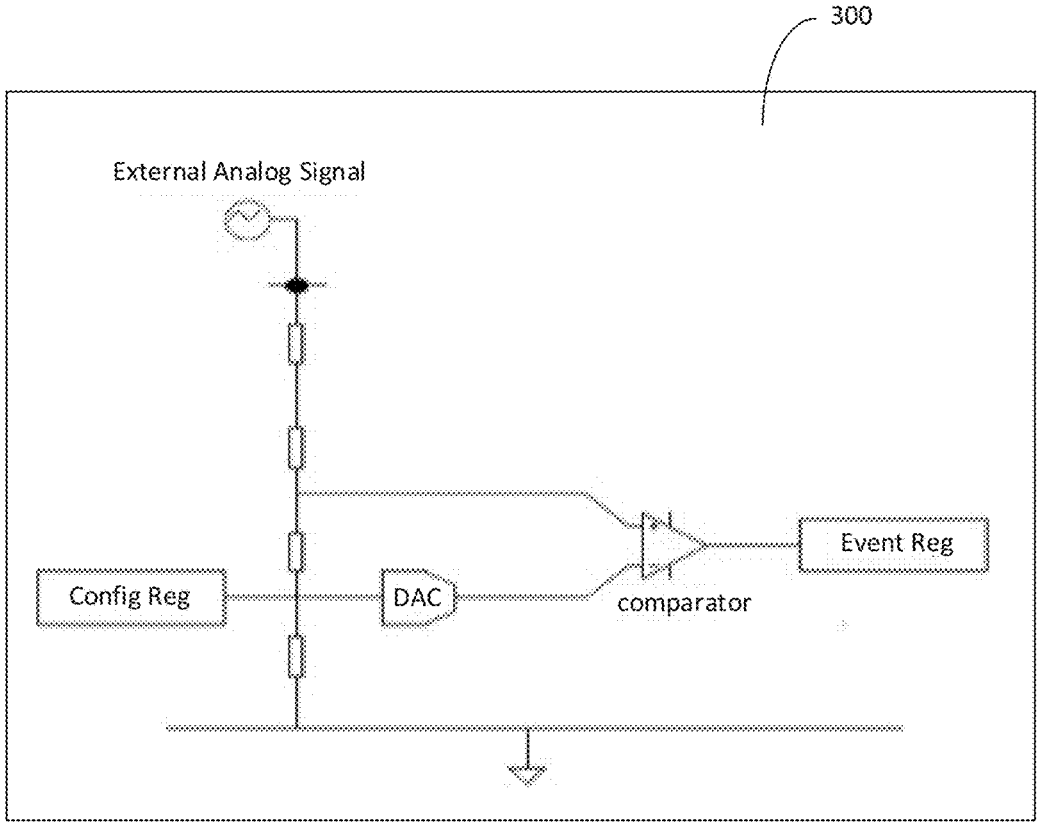
FIG. 3 is an exemplary schematic representation showing exemplary circuit components of the LED driver system of the invention showing the one or more events being generated due to an external event.

FIG. 3 is a block diagram 300 schematic of the event generation due to an external input (referred herein as external signal sometimes). The external analog signal referred herein is an external signal such as output voltage of the driver system, input resistor value at a pin etc. This external analog signal needs to be compared to an internally programmed value which is referred to as a programmed or pre-determined parameter. This internal value or programmed parameter is digitally programmed in the configuration register. This digitally programmed value is converted to analog value through a DAC (Digital to Analog converter).

As an example, when the external analog signal value is greater than the internally programmed value, the comparator output is high (1) and stored in event resister as 1; If it is lower than internal value then it is stored as zero (the polarity is for representation). The event register value thus creates an event. The key advantage of the exemplary implementation is that there is no need of continuous monitoring of an external signal. The partition in analog and digital domain creates an event architecture upon which an action is performed.

Figure 4:
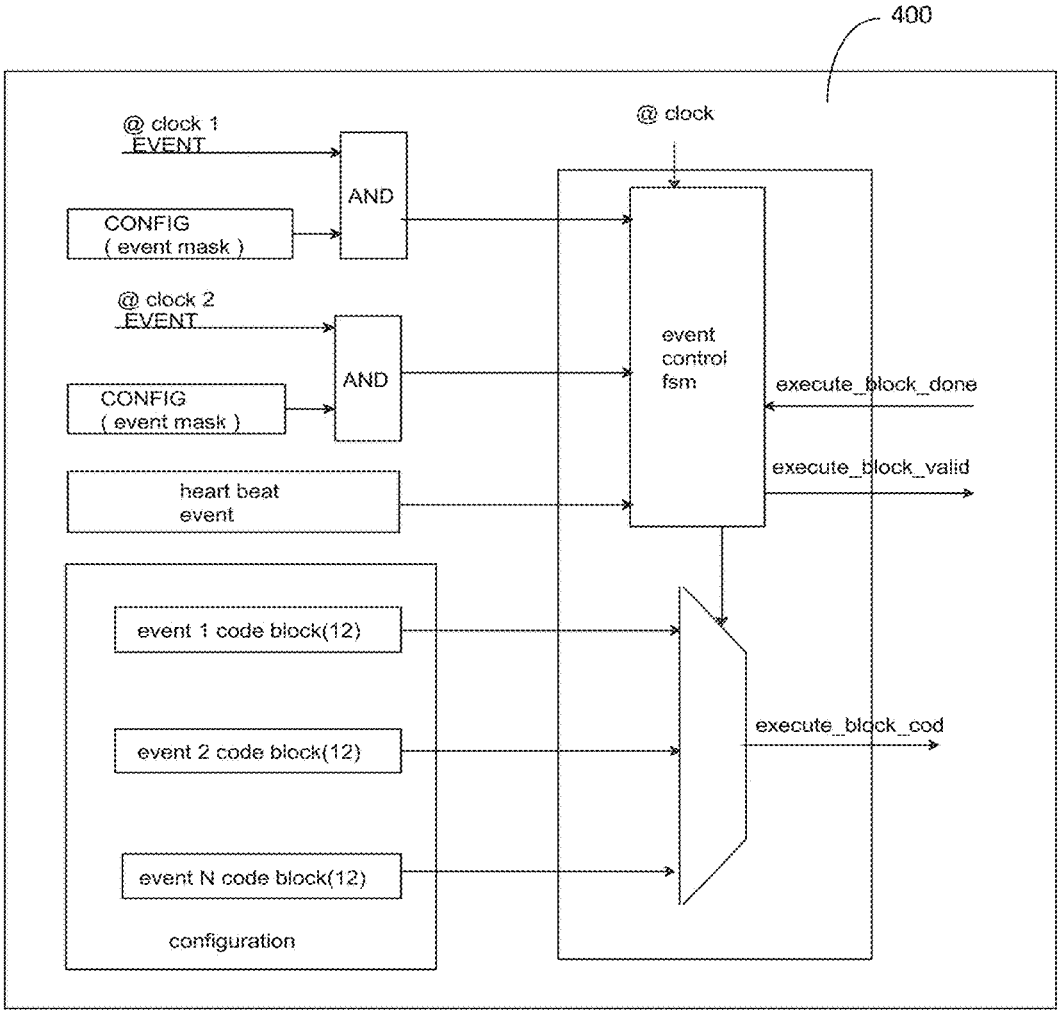
FIG. 4 is an exemplary schematic representation showing exemplary circuit components of a digital block for LED driver system of the invention.

FIG. 4 is a diagrammatic representation 400 showing an implementation with multiple clocks and the event flow in the event register in the exemplary implementation. It would be appreciated by those skilled in the art that the multiple blocks (events) can be clocked at different speeds to ensure optimal power and architecture integration. The events are clocked into event register and each event has configuration bits to control priority and code block for subsequent action. Each event signal from hardware block is port mapped to a specific channel of event generator. It may be noted that the CPU as shown in FIG. 1 binds the various hardware and software blocks in a meaningful way to define the system for the required application/use.

Figure 5:
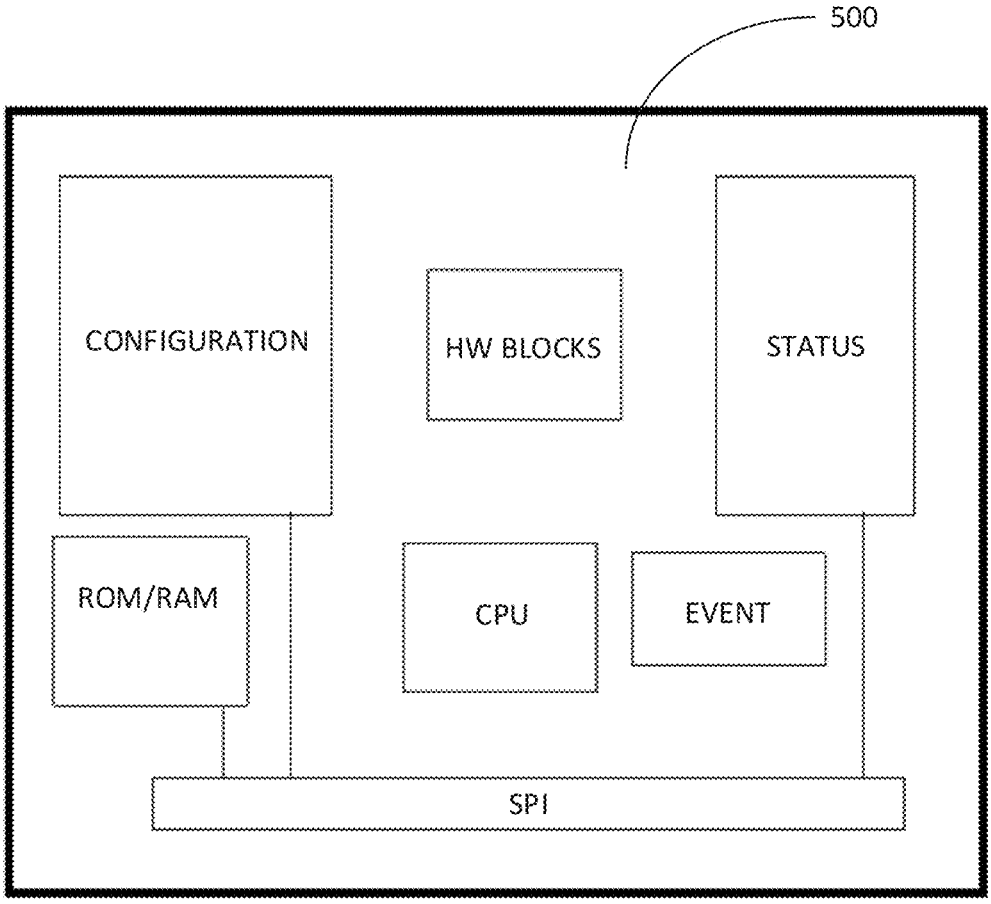
FIG. 5 is an exemplary schematic representation showing exemplary circuit components of the LED driver system of the invention that includes a communication interface to read and write contents on a plurality of registers in the analog module, digital module and the firmware module.

FIG. 5 is a diagrammatic representation 500 showing an exemplary external interface configured to communicate with the chip (implementation of driver system). An SPI (Serial Parallel interface) interface is shown as a non-limiting exemplary interface. The interface can communicate with configuration registers, status registers and internal RAM/ROM memory element. This facilitates controlling/debugging (including on the fly debugging) of the chip from an external code, configuring parameters through configuration register, and/or observing/monitoring the status register.

Figure 6:
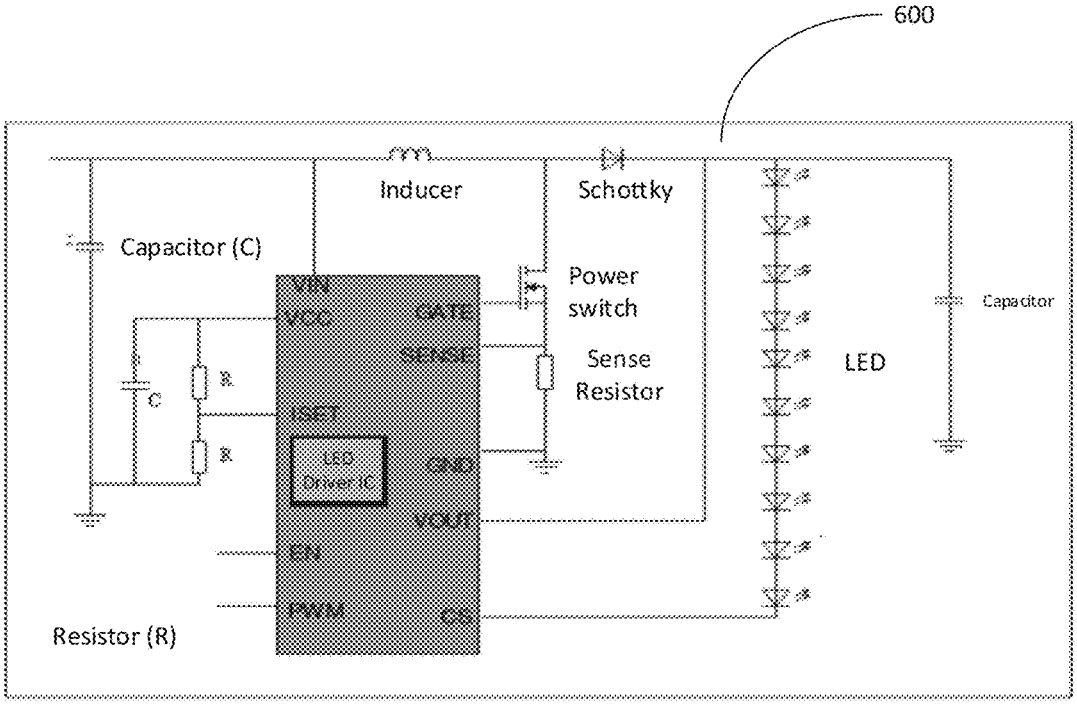
FIG. 6 is an exemplary schematic representation showing exemplary circuit components of the LED driver system of the invention where LED currents are defined through a current source architecture.

FIG. 6 is a diagrammatic representation 600 to show an exemplary implementation for a single channel LED driver system.

It may be noted here that in the LED driver system, all analog signals such as external output voltage, feedback signal, temperature, LED currents are all processed by dedicated analog blocks. It may be further noted that the dimming (both pulse Width modulation (PWM) and Analog) are implemented in digital domain. The digital processing techniques used to eliminate flicker issues, improve linearity in deep dimming, improve noise immunity from external dimming signal and at the same time does not compromise resolution. In an essence, only blocks that require absolute digital functionality are implemented in digital domain.

The firmware module defines system response and thus the customized solutions can be provided without the expensive and time consuming full IC (sometimes referred herein as chip or driver IC) design and development. The firmware module can be implemented on an external source such as EEPROM chip, medium, or internally integrated in the driver IC through EEPORM or through a custom metal mask based ROM. The system described herein thus provides a dedicated low power analog embedded LED driver architecture.

The above system and method is advantageous over the available microcontroller based solutions that are expensive in terms of power and additional components (e.g) microcontroller, power supply for microcontroller and a LED Driver that require larger solution space (board space) and system cost.

Another advantage of the system and method described herein is that in hard to specify LED driver interactions with lighting systems, the firmware can be developed on the fly with the LED driver system of the invention on the lighting application system itself. Once the appropriate solution is reached, it can be written to memory element of the firmware through an interface, then the actual chip can be taken to production thus enabling prototype validation prior to production.

Yet another advantage of the system described herein is that the system reduces external components (BOM cost), higher functionality and low development time to market and multiple customized products. This is an excellent fit for applications in back lighting, solid state lighting and automotive lighting applications.

The basic architecture can additionally be used to operate systems as below:

a. In one implementation a power converter is operated in a constant frequency mode and LED currents are defined through a current source architecture. The firmware can also be used to operate a power switch at a constant ON time, constant OFF time, Hysteretic mode, a constant frequency mode or a variable frequency mode.

b. In another implementation, the LED currents can also be derived through a resistor approach (V/R approach) instead of current source approach.

Figure 7:
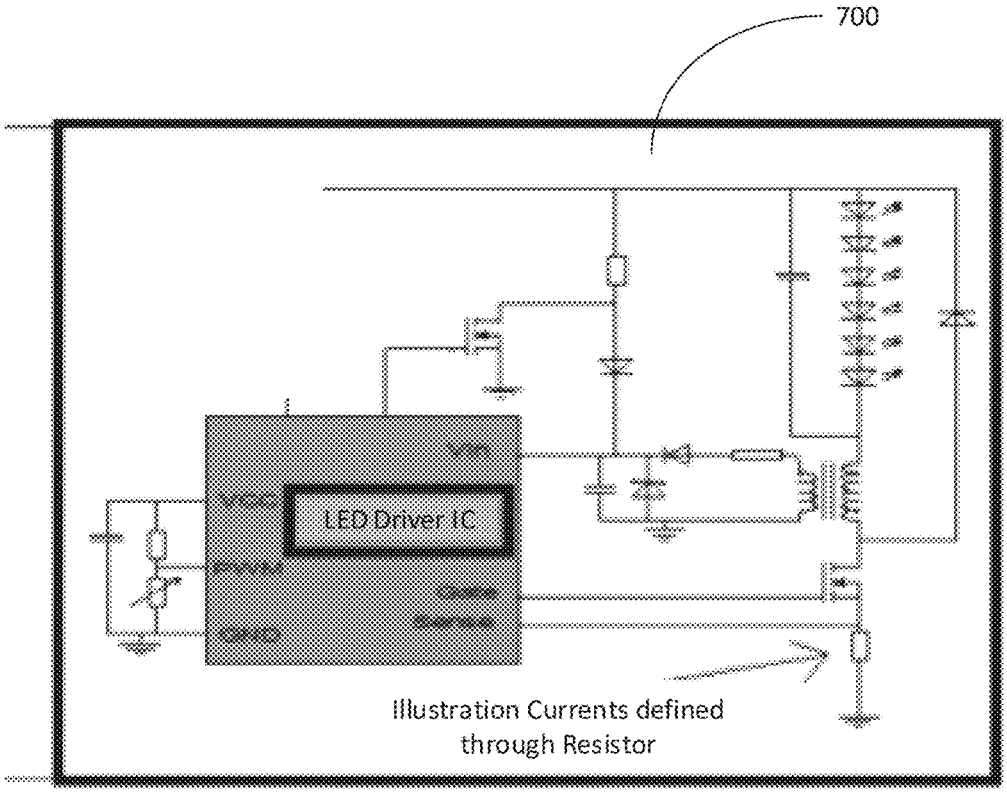
FIG. 7 is an exemplary schematic representation showing exemplary circuit components of the LED driver system of the invention where LED currents derived through a resistor approach.

Another exemplary implementation 700 of the LED driver circuit is shown in FIG. 7 in an exemplary resistor approach, where currents are defined through resistors.

The LED driver system described herein is a closed loop system in which the output is powered to the optimal voltage level to ensure LEDs are properly and efficiently driven. The control loop can be implemented in analog or digital domain. In a specific embodiment as described herein the control loop is in digital domain to give greater flexibility in terms of system response, such as programmable non linear gain, varying gain for different application, ease of internal digital compensation, and thereby eliminating the need for complicated analog compensation techniques.

Figure 8:
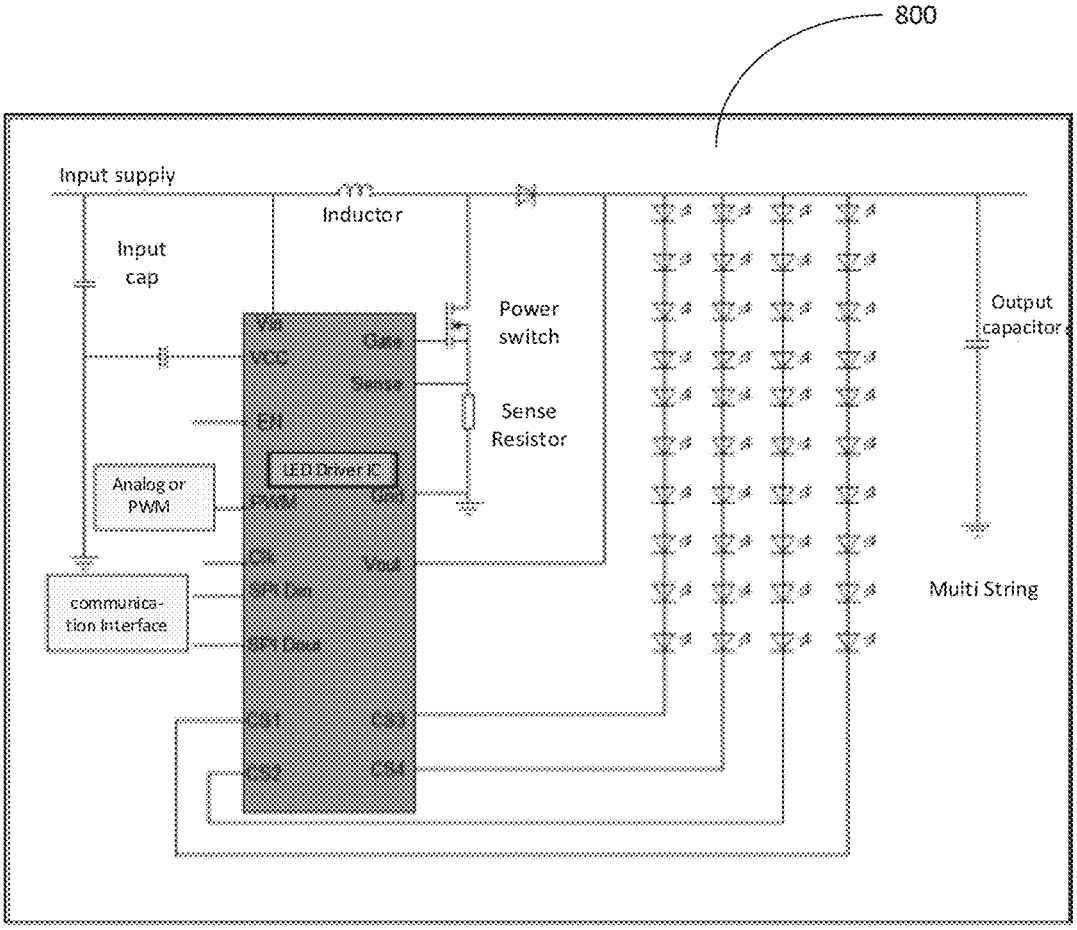
FIG. 8 is an exemplary schematic representation showing exemplary circuit components of the LED driver system of the invention for a multi-string operation.
Figure 9:
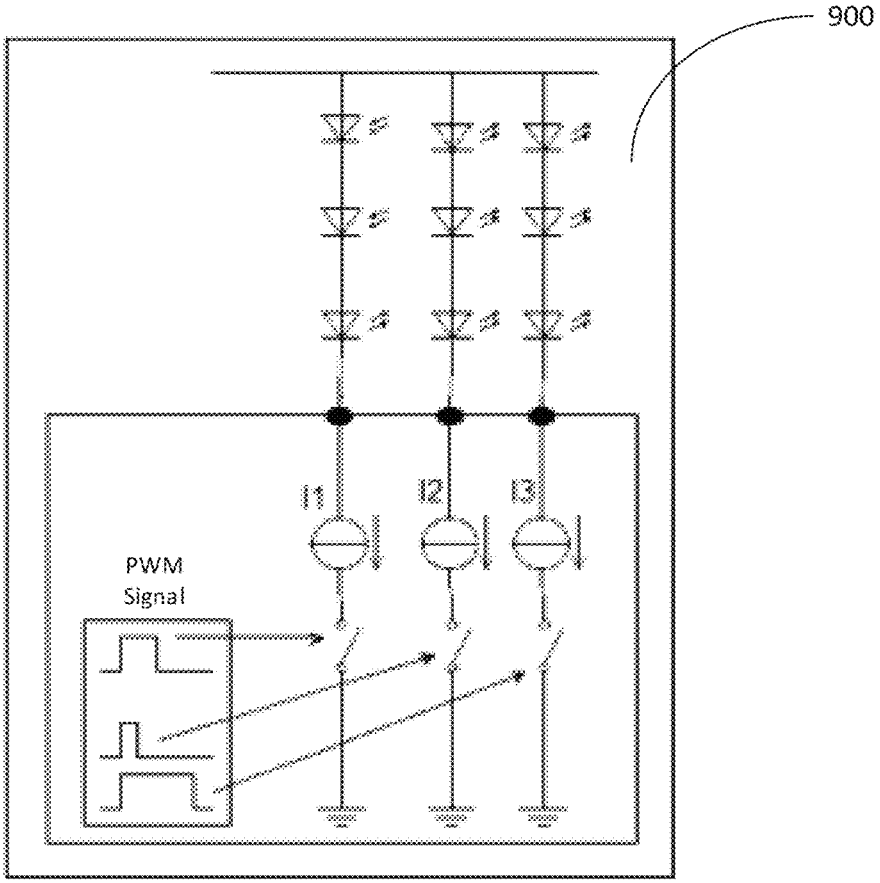
FIG. 9 is an exemplary schematic representation showing exemplary circuit components of the LED driver system for a multi string operation where each string is operated at a different LED current and PWM-DC.

It may be noted that in a multi channel or multi string architecture 800, as shown in FIG. 8, the loop is regulated to longest string and if the longest string encounters a fault such as open LED, or short LED, the architecture is intelligent enough to mark out the faulty string and re-regulate to next longest string. Further, in multi string architecture of the prior art systems, each string is periodically observed for potential fault scenarios. In a typical digital architecture (prior art) faults are periodically monitored (time based) which leads to an increased monitor (firmware) over head, clock speed and further leads to a trade off between system power, complexity and accuracy. This trade off is severe as number of strings increases in the system. In the system of the invention described herein this deficiency in the prior art systems is overcome since a potential fault creates an event and results in an action as per the firmware. The event based multi string architecture monitoring results in simpler monitoring scheme without the trade off between power & accuracy. On detection of fault, system responds as per the firmware, and the system goes though a low power diagnosis mode. After all faults are detected and accounted, the system resumes the steady state operation. Since the fault response is event based there is no need for periodic monitoring as is required in prior art systems. The entire system response is controlled through firmware. Thus each channel can be independently controlled as shown in the implementation 900 of FIG. 9 that illustrates independent PWM control i.e. PWM DC can be different and current control i.e LED currents can be different for each string.

It would also be appreciated by those skilled in the art that the driver system described herein is intelligent enough to distinguish between start up condition and faults such as LED short, open conditions. The firmware can also be used to operate power switch (fundamental switch used to energize inductor) as a controlled resistor.

Figure 10:
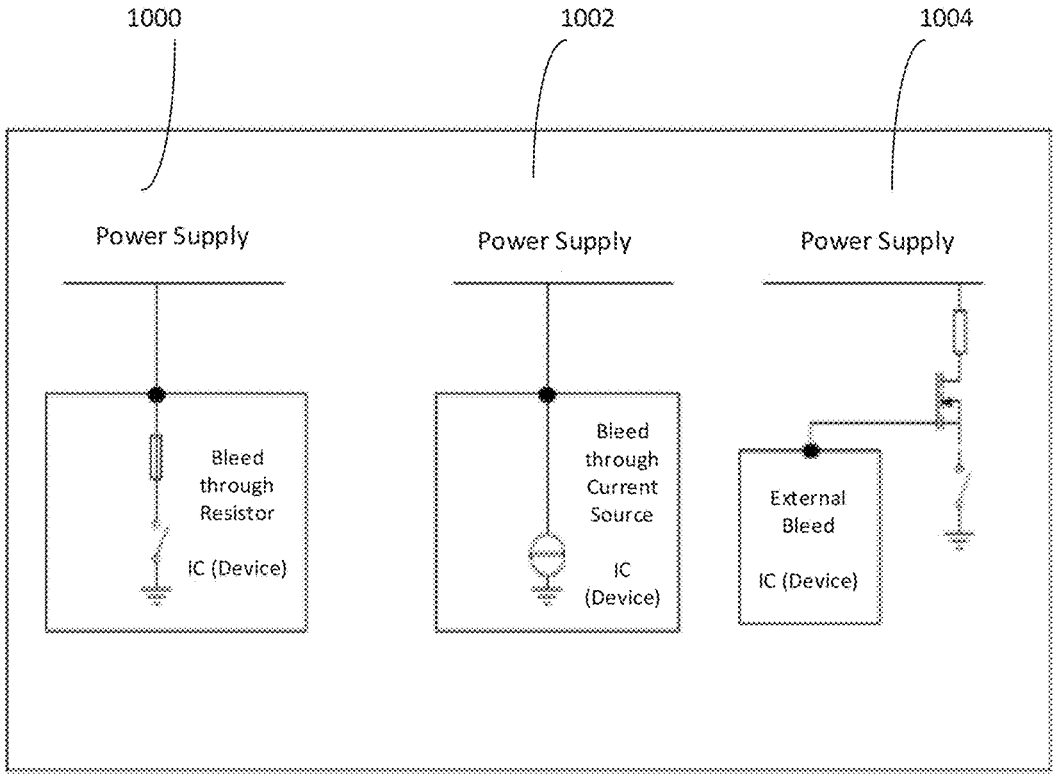
FIG. 10 is an exemplary schematic representation showing exemplary circuit components of the LED driver system for power management for the LED.

The architecture can be used to increase power consumed from external sources when over all system power consumption falls below a pre specified value. FIG. 10 is an exemplary implementation for three current bleeding schemes 1000, 1002, and 1004 for implementing this functionality. This is useful to eliminate flicker on certain dimmer systems, such as Triac dimmers, EL transformers that expects a minimum output power to work reliably. The architecture has an internal PWM signal generator. Thus it can be seen that the driver system of the invention can be configured to add bleeder (load) and power supply.

Figure 11:
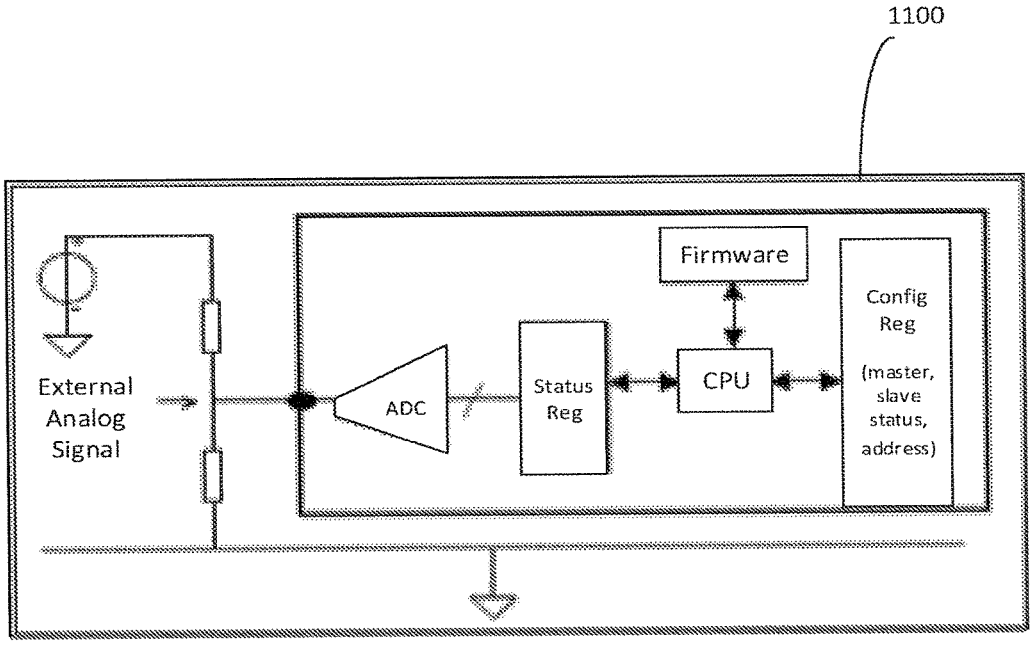
FIG. 11 is an exemplary schematic representation showing exemplary circuit components of the LED driver system for a master-slave configuration application.

The architecture in FIG. 11 shows as another implementation 1100 of the driver system as a Single Pin Analog addressing scheme where the analog signal level is established through, say, a resistive divider. The ADC is used to convert the analog signal to a digital level. This digital level creates a status (event). Firmware is activated upon the event to configure the address register. Thus it becomes easy to signify master, slave status and address of each of the ICs in a multi chip system. Thus the inter chip communication is possible without external microcontroller, thus eliminating/minimizing the need for external micro-controller.

It would be appreciated by those skilled in the art that the techniques and systems described herein in relation to LEDs, and event based integrated driver system approach is also applicable to other systems such as power supply sequencing, voltage regulators, battery chargers. The event based architecture as described herein decreases the digital current, enabling lower analog current. Event based architecture described herein judiciously combines analog output and digital content. As a rule of thumb for a given accuracy/monitoring requirement, analog power consumption is lot lower than digital power. The event based architecture eliminates periodic digital monitoring & thereby lowers total power consumption. Event based architecture as described herein lowers power consumption by more than two times, over time based monitoring systems which results in low operating power without sacrificing accuracy. The event based architecture as described herein supports both functional and production test development code on the fly. This gives greater flexibility in optimizing test coverage on production environment.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. An event based integrated driver system for an end-use power based application, the driver system comprising:

an analog module for receiving and processing an analog input;

a digital module for receiving and processing a digital input;

a software module for receiving and processing a software input;

an event based module, the event based module triggers an analog event based on the processed analog input when the analog module receives and processes the analog input, a digital event based on the processed digital input, when the digital module receives and processes the digital input, and a software event based on the processed software input when the software module receives and processes the software input; and a firmware module, the firmware module maps the analog event, the digital event, and the software event when triggered by the event module, wherein the analog, the digital and the software events comprise an event priority, and comprises instructions for processing the analog event, the digital event and software event according to the event priority by the analog module, the digital module and software module based on the end-use power based application.

2. The driver system of claim 1 comprises a master/slave configuration including a plurality of integrated chips with appropriately assigned addresses using an analogy address signal through a single pin.

3. The driver system of claim 1 wherein the digital module comprises one or more digital blocks based on one or more functionality requirements.

4. The driver system of claim 3 wherein the one or more digital blocks operate at different clock speeds.

5. The driver system of claim 1 wherein the firmware module further comprises a debug controller to debug an integrated chip configured for the end-use power based application.

6. The driver system of claim 1 wherein the response is a communication trigger in the master-slave configuration of a plurality of integrated chips configured for the end-use power based application, wherein an analog input is used to configure the master-slave configuration and assign an address.

7. The driver system of claim 1 further comprising a communication interface to read and write contents on a plurality of registers in the analog module, digital module and the firmware module.

8. The driver system of claim 7 wherein the communication interface is configured to display driver parameters, fault warnings, a message useful for monitoring and control operation.

9. The driver system of claim 1 wherein the driver system is a light emitting diode (LED) driver system configured to regulate LED current, detect and respond to faults, wherein the end-use power based application is a lighting application.

10. The LED driver system of claim 9 wherein the LED driver system supports a single string operation.

11. The LED driver system of claim 9 wherein the LED driver system supports a multi-string operation, wherein a response of each string is controlled through the firmware module.

12. The LED driver system of claim 9 wherein the firmware module is flexible for on the fly instructions for prototype validation.

13. The LED driver system of claim 9 comprising a power converter at constant frequency mode; and wherein LED currents are defined through a current source architecture.

14. The LED driver system of claim 9 wherein the firmware module is configured to operate a power switch at a constant ON time, constant OFF time, Hysteretic mode, a constant frequency mode or a variable frequency mode.

15. The LED driver system of claim 9 comprising:

a power converter; and wherein LED currents derived through a resistor approach.

16. The LED driver system of claim 9, wherein the LED driver system is a closed loop system, wherein an output is powered to optimal voltage level, and a control loop is at least one of an analog or digital domain.

17. The LED driver system of claim 16, wherein in a multi-string operation, the control loop is regulated to longest string using instructions in the firmware module, and in an event of a fault, the control loop detects a faulty string and re-regulates to next longest string.

18. The LED driver system of claim 17, wherein the firmware module comprises instructions based on the events to respond to a potential fault.

19. The LED driver system of claim 17, wherein each string is configured to operate at a different LED current and PWM-DC.

20. The LED driver system of claim 17 wherein the LED driver system is configured to increase power consumed from external sources when over all system power consumption falls below a pre specified value, as per the firmware module.

21. The LED driver system of claim 9 comprising an internal PWM engine.

22. The driver system of claim 1 wherein the driver system is scalable and is configured for addition or removal of one or more components of the analog module or the digital module or the software module and combinations thereof.

23. The driver system of claim 1 wherein the driver system is configured for reducing power consumption.

* * * * *